United States Patent [19]

Gaboriault

[11] 4,244,271

[45] Jan. 13, 1981

[54] AMMUNITION FEED TIMING MECHANISM

[75] Inventor: Roger E. Gaboriault, Williston, Vt.

[73] Assignee: The United States of America as represented by the Secretary of the Air Force, Washington, D.C.

[21] Appl. No.: 2,280

[22] Filed: Jan. 10, 1979

[51] Int. Cl.[3] ..... F41D 10/22

[52] U.S. Cl. ..... 89/33 BB

[58] Field of Search ..... 89/33 R, 33 BA, 33 BB, 89/33 BC, 33 CA, 34

[56] References Cited

U.S. PATENT DOCUMENTS

| | | | |
|---|---|---|---|
| 3,618,454 | 11/1971 | Christenson | 89/33 BB |
| 3,696,704 | 10/1972 | Backus et al. | 89/33 BB |

*Primary Examiner*—Stephen C. Bentley

*Attorney, Agent, or Firm*—Donald J. Singer; Arsen Tashjian

[57] ABSTRACT

The entrance and exit units to an ammunition feed system are provided with a foolproof timing arrangement wherein the units and drum are both in timed position when being mated together and also when being disengaged. The exit and/or entrance units are held in timed position by a spring loaded lever while disconnected and the lever is automatically released when the unit is mounted to the drum, allowing the shafts to turn with the drum. The drum may be held in timed position when the entrance and/or exit units are disconnected or may be allowed to rotate by releasing spring loaded mounting pins.

2 Claims, 3 Drawing Figures

AMMUNITION FEED TIMING MECHANISM

STATEMENT OF GOVERNMENT INTEREST

The invention described herein may be manufactured and used by or for the Government for governmental purposes without the payment of any royalty thereon.

BACKGROUND OF THE INVENTION

This invention relates to a means for timing the entrance and exit units to the ammunition storage drum of a linkless ammunition feed system and, more particularly, the invention is concerned with providing a positive timing device which insures that the units and drum are both in timed position when being mated together and also when being separated.. The units and drum can be held in timed position when disengaged so that the belt tension in the conveyor will not change and the drum will not rotate causing rounds to fall out of the drum.

Presently, the system of timing demountable entrance and exit units in an ammunition handling mechanism is most commonly accomplished by spring loaded timing pins which must be manually depressed on each unit and the drum when the units are mated to the drum. In order to prevent mistiming, timing gears and/or gears with timing plates are sometimes used. In recent installations, spring loaded rods indexing a slot in a gear on the entrance and exit units have been used in an attempt to insure that the units cannot be mounted when not in the timed position. However, this does not insure that the ammunition drum to which the units are mounted is in timed position and mistiming between the units and the drum could result.

Thus, there is a definite need for a foolproof timing device for mounting exit and entrance units to a linkless feed ammunition storage drum. In an ideal linkless ammunition feed system the exit and/or entrance units could not be mounted to the drum unless both units and the drum were in timed position. The exit and/or entrance units should not be removable from the drum unless both the units and the drum are in timed position. However, in case of a jam, the units should be removable by unbolting some timing features. Another desirable feature for providing a foolproof timing system would be to hold the exit and/or entrance units in timed position by a spring loaded lever while disconnected. The lever would automatically release when either unit is mounted to the drum, allowing the shafts to turn with the drum.

SUMMARY OF THE INVENTION

The invention is concerned with providing a foolproof timing mechanism suitable for mounting exit and entrance units to a linkless feed ammunition storage drum. The invention provides that the units and drum are both in timed position when being separated. Also, the units and drum can be held in timed position when disengaged. This insures that the belt tension in the conveyor will not change and that the drum will not rotate causing rounds to fall out of the drum. This feature is particularly desirable in an installation where the exit and entrance units must be disengaged in the aircraft before the drum and feed system can be removed. It is also a considerable advantage to be able to pre-time the units and the drum before mounting the drum in the aircraft.

Accordingly, it is an object of the invention to provide a positive timing device for mounting exit and entrance units to a linkless feed ammunition storage drum wherein the exit and/or entrance units cannot be mounted to the drum unless both the units and the drum are in timed position.

Another object of the invention is to provide a foolproof timing mechanism wherein the exit and/or entrance units to a linkless feed ammunition storage drum cannot be removed from the drum unless both the unit and the drum are in timed position. This feature can be overridden in case of a jam by unbolting some timing elements.

Still another object of the invention is to provide a positive timing device suitable for mounting exit and entrance units to a linkless feed ammunition storage drum wherein the exit and/or entrance units are held in timed position by a spring loaded lever while disconnected. The lever is automatically released when the unit is mounted to the drum, allowing the shafts to turn with the drum.

A further object of the invention is to provide a foolproof timing mechanism for mounting exit and entrance units to a linkless feed ammunition storage drum wherein the drum may be held in timed position when the units are disconnected or may be allowed to rotate by releasing the spring loaded mounting pins.

These and other objects, features and advantages will become more apparent after considering the following detailed description taken in conjunction with the annexed drawings and appended claims.

DESCRIPTION OF A PREFERRED EMBODIMENT

Figure 1:
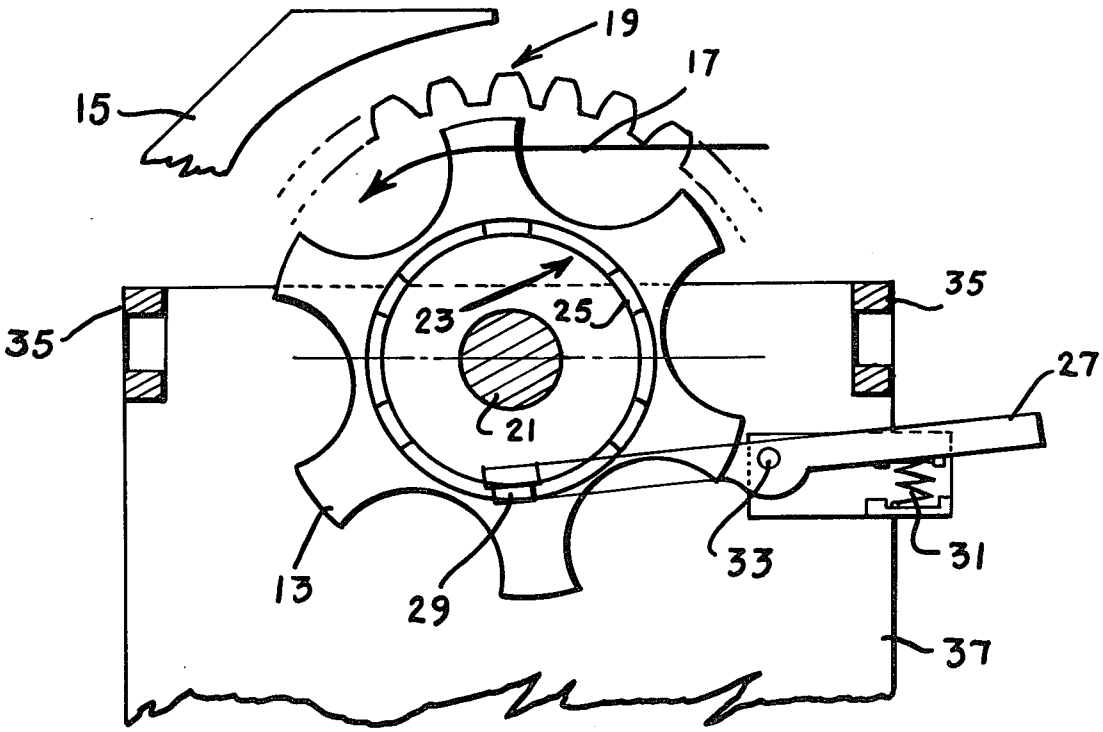
FIG. 1 is a view of the exit unit-off drum according to the invention showing a cross section of the scoop sprocket and mounting area illustrating how the exit unit is held in timed position by a spring loaded lever while disconnected.

Referring now to the drawings in which like reference numerals refer to the same elements in the several views, there is shown a positive timing device according to the invention which provides a foolproof timing mechanism for mounting exit and entrance units to a linkless feed ammunition storage drum. In the drawings, only the exit unit is shown. However, the same mechanism applies to the entrance unit. For simplicity, only the exit unit will be described in detail in the following description. FIG. 1 shows a cross section of the scoop sprocket 13 which has the function of scooping the rounds from the drum as they are being transferred into the scoop guide 15 which is attached to the housing. The rounds follow the path shown by the arrow 17 and the spur gear 19 is the drive for the sprocket 13 which rotates around the sprocket shaft 21.

The scoop sprocket 13 must be timed to the ammunition drum to insure transfer to the round. A raised ring 23 having a series of timing slots 25 therein is positioned on the sprocket 13. A spring loaded timing lever 27 is provided with a protrusion 29 which drops into the timing slots 25 thereby preventing the scoop sprocket 13 from rotating. The compression spring 31 urges the outer end of the timing lever 27 upward causing it to turn around the pivot 33 and force the protrusion 29 into the timing slot 25. Since the lever 27 is spring loaded in this position, the exit and/or entrance units are held in timed position by the lever 27 while disconnected. A pair of mounting lugs 35 are provided on the housing 37 for mounting the exit unit on the drum.

Figure 2:
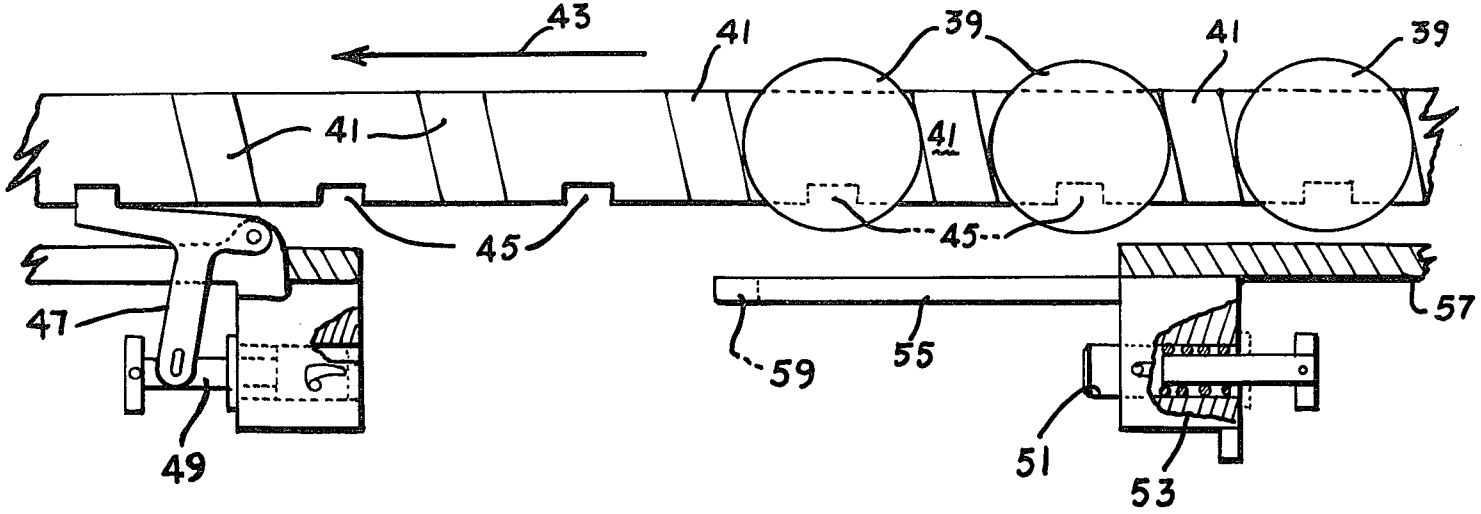
FIG. 2 is a view of the end of the ammunition drum with the exit unit removed (cross section in flat pattern) showing the rounds contained in retainer partitions that rotate about the centerline of the drum.

FIG. 2 depicts a cross section through the end of the ammunition drum shown without the exit unit mounted to it. An end view of the rounds 39 is shown. The rounds 39 are contained in retainer partitions 41 that rotate as shown by the arrow 43 about the centerline of the drum. The rounds 39 are scooped from the partition 41 during operation of the system. It is these partitions 41 that the exit unit must be timed with. Once the exit unit is mounted to the drum in timed position, the scoop sprocket 13 and retainer partitions 41 remain synchronized by gearing between the two during operation. Timing is accomplished by means of the timing slots 45 in the retainer partitions 41.

A drum timing lever 47 indexes into the timing slots 45, and is also coupled to the exit unit mounting pin 49 which is shown in the retracted position. The pin 51 shown in the engaged position also serves as a mounting pin for the exit unit and includes a compression spring 53 which urges the pin 51 inward to engage one of the lugs 35 on the exit unit. The pins 49 and 51 must be retracted to allow the exit unit to be mounted to the drum and the pin 49 cannot be retracted unless the retainer 41 is in timed position. This insures that the drum will be in timed position when the exit unit is being attached. The mounting pins 49 ad 51 have the capability of being retained in retracted position by means of a cross pin being rotated in an "L" shaped slot. When the mounting pin 49 is retracted and rotated 90°, it will be retained in retracted position and thus will hold the drum in timed position via the attached timing lever 47.

Figure 3:
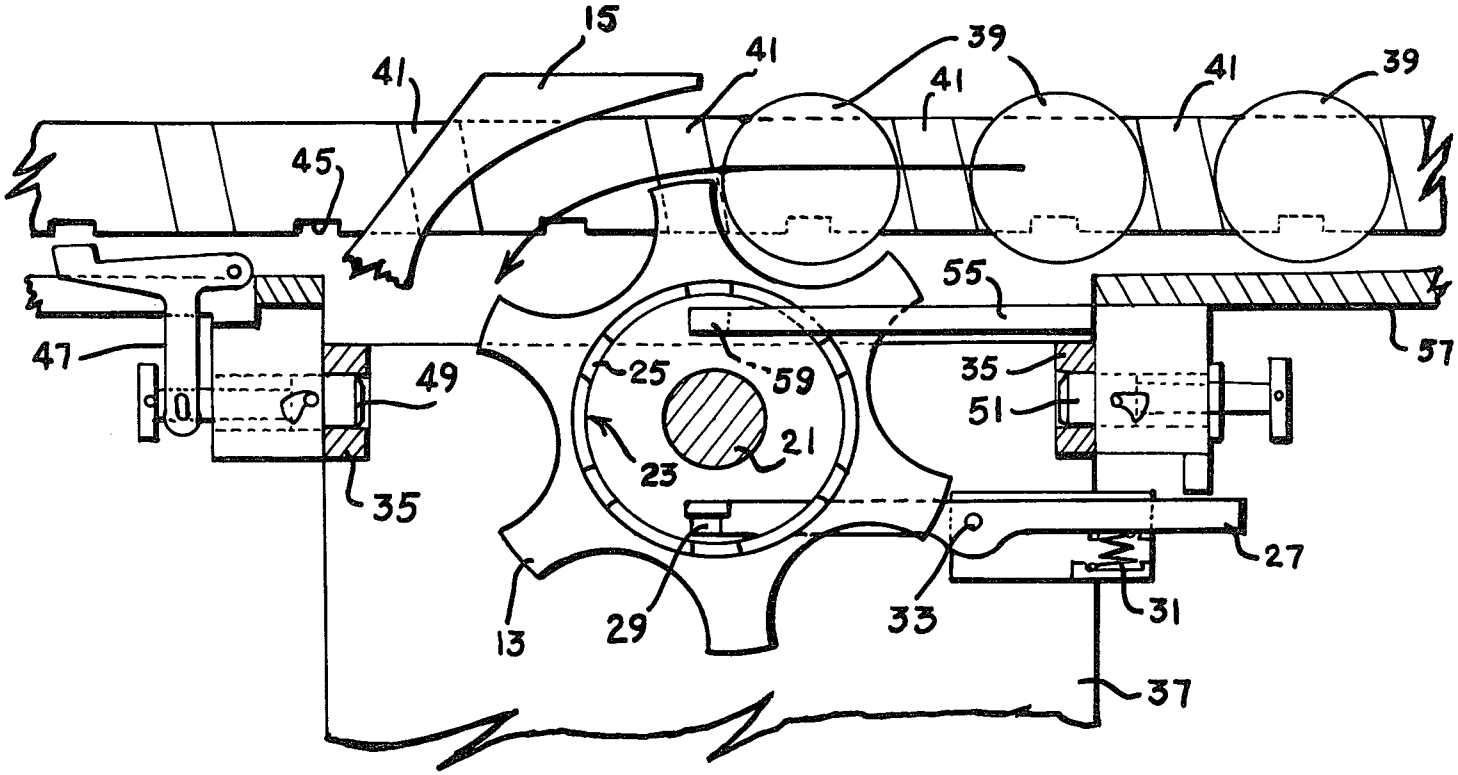
FIG. 3 is a view of the exit unit mounted to the drum cover showing the timing lever on the exit unit pivotted out of engagement with the timing slots of the scoop sprocket.

FIG. 3 shows the exit unit mounted to the drum cover. When mounted to the drum, the timing lever 27 on the exit unit is pivoted so that the protrusion 29 is no longer engaged in the timing slot 25 of the scoop sprocket 13. When the exit unit is mounted or demounted from the drum, the mounting pins 49 and 51 must be retracted, thus assuring the drum is in timed position. A timing arm 55 is attached to the drum cover 57 and extends inwardly to the center of the opening therein. A protrusion 59 is positioned on the inward end of the timing arm 55. When being mounted, the timing slots 25 in the scoop sprocket 13 must pass by the protrusion 59 on the timing arm 55 of the drum. If the sprocket 13 is not in timed position, the raised ring 23 on the sprocket 13 will not pass by the protrusion 59 on the timing arm 55 thus preventing the mounting of the unit. Also, the unit cannot be removed from the drum unless both the unit and the drum are in timed position. This condition can be overridden in case of a jam by unbolting some timing features.

Although the invention has been illustrated in the accompanying drawings and described in the foregoing specification in terms of a preferred embodiment thereof, the invention is not limited to this embodiment. It will be apparent to those skilled in the art that the hereinbefore described positive timing device is particularly adaptable for use with automatic weapons on high performance military aircraft. Also, it should be noted that certain changes, modifications and substitutions can be made in the construction details, such as the placement of the various pins and levers without departing from the true spirit and scope of the appended claims.

Having thus described the nature of my invention, what I claim and desire to secure by Letters Patent of the United States is:

1. A positive timing mechanism for mounting exit and entrance units to a linkless feed ammunition rounds storage drum comprising a scoop for transferring the rounds to and from the drum to the exit and entrance units, a rotatable scoop sprocket for scooping the rounds during the transfer operation, means for synchronously timing the rotation of said scoop sprocket with the movement of the drum, means for maintaining the exit and entrance units in synchronous timing with the drum including a raised ring extending axially outward from the surface of said scoop sprocket, a series of timing slots equally spaced in the wall of said raised ring, a spring loaded timing lever pivotally mounted for radial movement relative to said raised ring, and a protrusion on the inner end of said spring loaded timing lever for engagement with one of said series of timing slots when said protrusion and slot are in alignment to prevent rotation of said scoop sprocket when dismounted from the drum, means for preventing the mounting and dismounting of the exit and entrance units on the drum unless and until the units are synchronously timed therewith including a timing arm extending inwardly to the center of an opening in which the units are positioned and a protrusion on the inner end of said timing arm in alignment with one of said series of timing slots in said raised ring such that the raised ring on said scoop sprocket will allow the protrusion on said timing arm to pass therethrough only in the properly timed position, thereby providing foolproof timing of the exit and entrance units with the drum and maintaining the timed positions after detachment therefrom.

2. The positive timing mechanism for mounting exit and entrance units to a linkless feed ammunition rounds storage drum defined in claim 1 wherein said means for synchronously timing the rotation of said scoop sprocket with the movement of the drum includes a drum timing lever pivotably mounted on the drum cover, a series of timing slots on the drum for engagement with said drum timing lever when the exit and entrance units are dismounted thereby maintaining the drum in a fixed timed position when the exit and entrance units are dismounted.

* * * * *